United States Patent [19]

Hashimoto et al.

[11] Patent Number: 4,844,755

[45] Date of Patent: Jul. 4, 1989

[54] HIGH-STRENGTH HEAT-RESISTING FERRITIC STEEL PIPE AND TUBE

[75] Inventors: Katukuni Hashimoto; Yasuo Otoguro, both of Sagamihara; Toshio Fujita, Tokyo, all of Japan

[73] Assignee: Nippon Steel Corporation, Tokyo, Japan

[21] Appl. No.: 239,037

[22] Filed: Aug. 29, 1988

Related U.S. Application Data

[63] Continuation of Ser. No. 1,351, Jan. 8, 1987, abandoned, Continuation-in-part of Ser. No. 838,378, Mar. 11, 1986, abandoned.

[30] Foreign Application Priority Data

Apr. 6, 1985 [JP] Japan ..... 60-73302

[51] Int. Cl.[4] ..... C22C 38/22

[52] U.S. Cl. ..... 148/325; 148/909; 148/334; 138/177; 420/66; 420/69; 420/106; 420/110

[58] Field of Search ..... 428/586; 420/64, 66, 420/67, 69, 106, 110, 111, 114; 148/12 B, 909, 325, 334; 138/177, DIG. 6

[56] References Cited

U.S. PATENT DOCUMENTS 4,799,972 1/1989 Masuyama et al. ..... 148/325

FOREIGN PATENT DOCUMENTS 55-104458 8/1980 Japan .

59-189640 9/1984 Japan .

60-19551 9/1985 Japan ..... 420/64

60190551 9/1985 Japan .

OTHER PUBLICATIONS

"Tetsu-To-Hagane", vol. 71, '85-51340, Sep. 5, 1985, by K. Oda et al. (Z-3).

"Tetsu-To-Hagane", vol. 71, '85-51341, Sep. 5, 1985, by K. Asakura et al. (MB-1, MB-3).

"Tetsu-To-Hagane", vol. 71, '85-51346, Sep. 5, 1985, by K. Oda et al. (S-3).

"Tetsu-To-Hagane", vol. 72, '86-5571, Mar. 4, 1986, by K. Oda et al. (ZL-3).

"Metals and Technology", vol. 56, pp. 2-8, Jan. 14, 1986 by T. Fujita. (TB-9, TB-12).

"Japanese Society for the Promotion of Science", vol. 26, No. 2, pp. 261-269, Jul. 8, 1985, by Oda et al. (S-3).

"Japanese Society For the Promotion of Science", vol. 26, No. 3, pp. 485-489, Nov. 5, 1985, by K. Asakura et al. (MB-2).

"Japanese Society For the Promotion of Science", vol. 27, No. 1, pp. 79-82, by K. Oda et al. (ZL-3).

*Primary Examiner*—Deborah Yee

[57] ABSTRACT

A high-strength, heat-resisting ferritic steel pipe or tube for boiler use containing 0.03 to 0.15% C, 0.1 to 1.5% Mn, 8 to 13% Cr, 1.8 to 3.0% W, 0.05 to 0.30% V, 0.02 to 0.12% Nb, 0.02 to 0.05% N, 0.02 to 0.4% Mo, and up to 0.25% Si. This pipe or tube has an improved high-temperature creep rupture strength and an excellent weldability and toughness.

12 Claims, 1 Drawing Sheet

HIGH-STRENGTH HEAT-RESISTING FERRITIC STEEL PIPE AND TUBE

This application is a continuation, of application Ser. No. 001,351 filed Jan. 8, 1987, which is continuation-in part of application Ser. No. 838378 filed Mar. 11, 1986, both now abandoned.

CROSS-REFERENCE TO RELATED APPLICATION

This application is a continuation-in-part application of U.S. Ser. No. 838,378, filed Mar. 11, 1986.

BACKGROUND OF THE INVENTION

1. Field of the Invention

The present invention relates to a high-strength heat-resisting ferritic steel pipe or tube, more particularly, to a heat-resisting ferritic steel pipe or tube containing chromium, the pipe or tube having improved high temperature creep characteristics and excellent weldability and toughness.

2. Description of the Related Art

In recent years, in the field of thermal power plant, plant sizes are increasing and the operating temperatures and pressures are rising. When selecting steel pipe or tube (hereinafter in this section, collectively referred to as steel tube) for use at elevated temperatures exceeding 550° C., inevitably high grade austenitic steel tubes, such as 18-8 stainless steel tubes are used instead of $2\frac{1}{4}$ Cr-1Mo ferritic steel tubes, from the viewpoint of oxidation resistance and high temperature strength.

As the grade of steel used becomes higher, i.e., from low alloy steel tube to stainless steel tube, or further, to super alloy tube, both tube and boiler construction costs are increased. This has led to the use of a super critical pressure boiler having an increased operating pressure, to improve boiler efficiency.

A steel tube that will fill the gap between $2\frac{1}{4}$ Cr-1Mo steel tubes and austenitic stainless steel tubes has been desired for many years. However, steel tubes with intermediate contents of Cr, i.e., 9Cr, 12Cr, etc., have an impaired weldability corresponding to an increase in the strength as compared with $2\frac{1}{4}$ Cr-1Mo steel tube. These steel tubes cannot be practically used because the impaired weldability considerably lowers the efficiency of boiler fabrication work.

Under these circumstances, research has been made by present inventors and others into the development of novel steel tubes having an improved weldability and a creep rupture strength superior to those of conventional tubes.

However, a further elevation of the steam temperatures utilized and frequent run/stop operations of the boiler caused by fluctuations in the demands for electric power are anticipated, and thus a reduced plant wall thickness, i.e., a further improved creep rupture strength, is desired in order to, e.g., mitigate thermal stress.

On the other hand, although it is disclosed in Japanese Examined Patent Publication (Kokoku) No. 58-17820 that a W addition at 1.5% or less is effective in improving creep strength, it does not mention the effect of Nb.

SUMMARY OF THE INVENTION

It is an object of the present invention to provide a high-strength heat-resisting ferritic steel pipe or tube having an improved creep rupture strength at a temperature of 600° C. and able to be used at a higher temperature range. To achieve this object, the present inventors found that it is effective to add 1.8% or more of W, which has a high melting point and low diffusion rate, and that part of the W addition may be replaced with Mo and no change in the effectiveness for improving the creep rupture strength will result therefrom.

On the basis of the above-mentioned findings, the present inventors succeeded in developing a new steel boiler pipe or tube having a superior creep rupture strength.

The steel pipe and tube according to the present invention have a tensile property, a weldability, and a resistance to heat embrittlement which are on the same level as or superior to those of conventional steels, which can be used only at temperatures lower than 600° C.

According to the present invention, there is provided a high-strength heat-resisting ferritic steel pipe or tube having an improved creep rupture strength, said steel consisting, in weight percentage of:

| | |
|---|---|
| C: | 0.03–0.15%, |
| Mn: | 0.1–1.5%, |
| Cr: | 8.0–13.0%, |
| W: | 1.8–3.0%, |
| V: | 0.05–0.30%, |
| Nb: | 0.02–0.12%, |
| N: | 0.02–0.05%, |
| Mo: | 0.02–0.4%, |
| Si: | 0.25% or less, |

with the remainder consisting of Fe and unavoidable impurities, and a high-strength heat-resisting ferritic steel pipe or tube having an improved creep rupture strength, said steel consisting, in weight percentage, of:

| | |
|---|---|
| C: | 0.03–0.15%, |
| Mn: | 0.1–1.5%, |
| Cr: | 8.0–13.0%, |
| W: | 1.8–3.0%, |
| V: | 0.05–0.30%, |
| Nb: | 0.02–0.12%, |
| N: | 0.02–0.05%, |
| Mo: | 0.02–0.4%, |
| Si: | 0.25% or less, |
| B: | 0.001–0.008% |

with the remainder consisting of Fe and unavoidable impurities.

In a high-strength heat-resisting ferritic steel pipe or tube according to the present invention, the content of C is preferably from 0.03 to 0.12% in weight.

A high-strength heat-resisting ferritic steel pipe or tube according to the present invention is preferably applied to steel pipe or tubes having a wall thickness of about 5 to 50 mm (about 0.2 to 2 inches).

In the present invention, steel pipe is used for the transfer of high temperature fluid and has an outer diameter of about 150 to 500 mm (about 6 to 20 inches), and steel tube is used for heating, e.g., conducting heat from the outside to the inside in the boiler super heater, and has an outer diameter of about 130 mm (about 5 inches) or less.

Table 1 shows four composition ranges of the steel pipes or tubes according to the present invention.

TABLE 1

| | Composition Range of the Steel Pipe or Tube of the Present Invention | | | (%) |
|---|---|---|---|---|
| | (1) | (2) | (3) | (4) |
| C | 0.03–0.15% | 0.03–0.12% | 0.03–0.15% | 0.03–0.12% |
| Mn | 0.1–1.5% | 0.1–1.5% | 0.1–1.5% | 0.1–1.5% |
| Cr | 8.0–13.0% | 8.0–13.0% | 8.0–13.0% | 8.0–13.0% |
| W | 1.8–3.0% | 1.8–3.0% | 1.8–3.0% | 1.8–3.0% |
| V | 0.05–0.30% | 0.05–0.30% | 0.05–0.30% | 0.05–0.30% |
| Nb | 0.02–0.12% | 0.02–0.12% | 0.02–0.12% | 0.02–0.12% |
| N | 0.02–0.05% | 0.02–0.05% | 0.02–0.05% | 0.02–0.05% |
| B | — | — | 0.001–0.008% | 0.001–0.008% |
| Mo | 0.02–0.4% | 0.02–0.4% | 0.02–0.4% | 0.02–0.4% |
| Si | 0.25% or more | 0.25% or less | 0.25% or less | 0.25% or less |
| Remainder | Fe and unavoidable impurities | Fe and unavoidable impurities | Fe and unavoidable impurities | Fe and unavoidable impurities |

DESCRIPTION OF THE PREFERRED EMBODIMENTS

Figure 1:
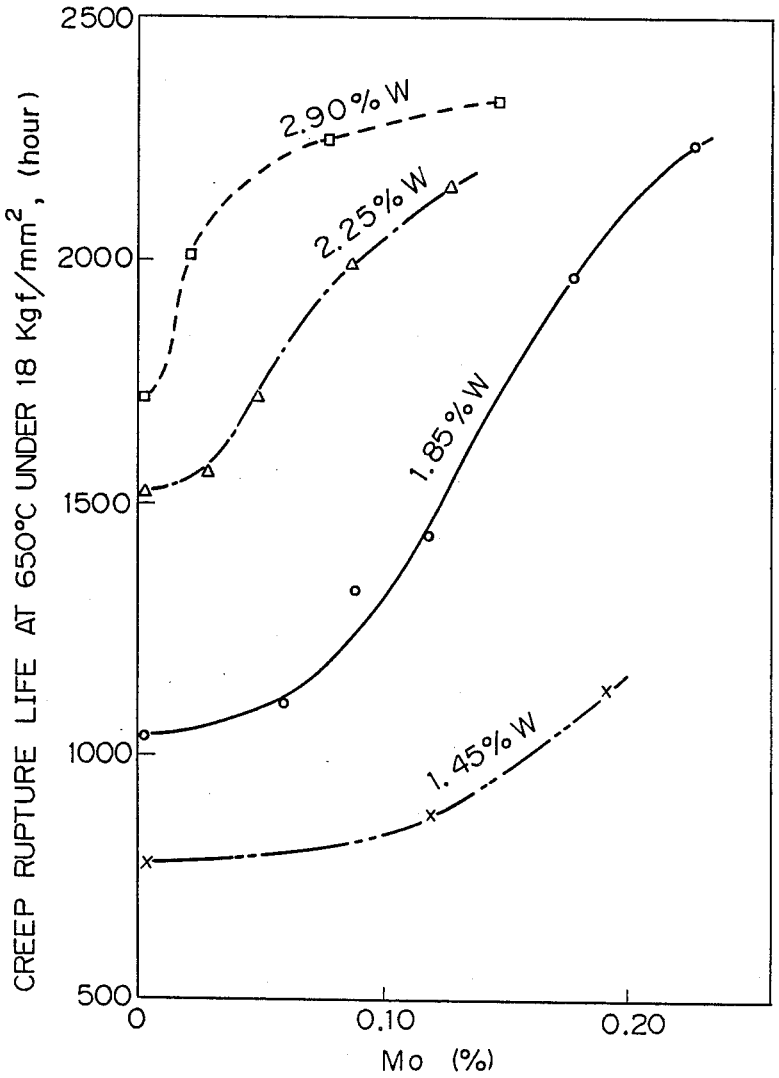
FIG. 1 shows the effect of the Mo content on the creep rupture life when the W content is varied.

The present invention will now be described in detail.

First, the reason for limiting each component covered by the present invention is described below. C is necessary for maintaining strength but is limited to 0.15% or less to maintain the weldability. That is, in accordance with the Cr content described later, these kinds of steel pipes and tubes have an extremely good hardenability such that the welding heat-affected zone hardens remarkably, which causes cold cracking upon welding. Therefore, in order to perform a complete welding, preheating at a considerably high temperature is necessary, which causes a significant decrease in the welding work efficiency.

However, if the C content is kept at 0.15% or less, the maximum hardness at the welding heat-affected zone is lowered to a degree such that welding cracking is easily prevented. Thus, the upper limit for the C content is set at 0.15%. When the C content is less than 0.03%, it is difficult to maintain the creep rupture strength and, therefore, the lower limit for the C content is set at 0.03%.

Mn is necessary for maintaining the strength, as well as for deoxidation. The upper limit for the Mn content is set at 1.5%, as the toughness should not exceed that brought about by a content of 1.5%, and the lower limit for the Mn content is set at 0.1%, which is the minimum amount necessary for deoxidation.

Cr is an indispensable element for oxidation resistance and is necessarily added to heat-resisting steels to obtain the resulting enhancement of the high temperature strength due to a fine precipitation of $M_{23}C_6$ and $M_6C$ (M denotes a metal element). The lower limit for the Cr content is set at 8%, at which limit a remarkable precipitation hardening is observed, and the upper limit for the Cr content is set at 13%, from the viewpoint of weldability and toughness.

W enhances the high temperature strength through solid solution strengthening and by controlling the coarsening of carbides as a solute therein, and is particularly effective for the strengthening at temperatures exceeding 600° C. over a long term period. The lower limit for the W content is set at 1.8% since the effect sharply increases at a content above 1.8%. The upper limit is set at 3% because the weldability, toughness after aging, and oxidation resistance are impaired if an amount exceeding 3% is added.

V, similar to W, remarkably enhances the high temperature strength of steel either in solid solution or in precipitation as precipitates. Particularly, when precipitation occurs, V precipitates as $V_4C_3$ and also partially substitutes for the M of $M_{23}C_6$ and $M_6C$. As a result, V exhibits a remarkable effect in the control of coarsening of the precipitates. However, at an amount of less than 0.05%, a creep rupture strength exceeding that of AISI TYPE 347 stainless steel at around 600° C. cannot be obtained, and an amount exceeding 0.30% only lowers the strength. Thus, the upper limit for the V content is set at 0.30%, and the lower limit for the V content is set at 0.05%.

Nb enhances the high temperature strength through the precipitation of Nb(CN) and also contributes to the long term creep rupture strength through a primary fine-dispersion precipitation and consecutively controlling of the subsequent precipitation of $M_{23}C_6$, $M_6C$, etc., to form precipitates having a refined morphology. A significant effect cannot be obtained when the amount of Nb is less than 0.02%, and the strength is lowered by coalescence coarsening when the amount of Nb exceeds 0.12%. Thus, the upper and lower limits for the Nb content are set at 0.12 and 0.02%, respectively.

The amount of V+Nb is preferably in the range of from 0.15% to 0.35%, from the viewpoint of creep rupture strength.

N enhances the creep rupture strength through solid solution strengthening in a matrix, or by precipitating as nitrides or carbonitrides. A N content below 0.02% sharply lowers the strength, and a N content above 0.05% causes problems such as the difficulty of producing sound steel ingots, due to the generation of blow holes during casting. Thus, the upper and lower limits for the N content are set at 0.05% and 0.02%, respectively.

Mo has an effect similar to that of W and effectively enhances the high temperature strength, but is less effective for the refinement and coarsening-control of carbide than W. However, in the region where the W content is 1.8% or more, the synergistic effect of W and Mo occurs and, therefore, the co-addition of these elements is preferable. However, an excessive amount of Mo has an adverse influence on the weldability, toughness after aging, and oxidation resistance, and thus the upper limit thereof is set at 0.4%.

The lower limit of the Mo content is set at 0.02% because of the following novel finding by the inventors: when a significant amount of W is contained, an addition of Mo even at an amount less than 0.1% remarkably improves the creep rupture characteristic. FIG. 1 shows the effect of the Mo content on the creep rupture life when the W content is varied, from which it can be seen that a minute addition of Mo has a significant effect on the increase of the creep rupture life especially when a greater amount of W is contained. The lower limit of the Mo content is 0.02% at which the effect of increasing the creep rupture life begins to appear remarkably when the W content is close to the upper limit according to the present invention.

Si is usually added for deoxidation but, in material property, has a detrimental influence on toughness.

The inventors studied the influence on toughness of Si, and found that the heat embrittlement is insignificant when the amount of Si is controlled to 0.25% or less. Thus, the amount of Si is limited to 0.25% or less, preferably 0.10% or less.

The steel pipe and tube according to the present invention may also contain B for further increasing the creep rupture strength. B is well known as essentially an element that remarkably enhances the hardenability, and a minute addition thereof remarkably improves the creep rupture strength. An amount below 0.001% does not have a significant effect, and an amount above 0.008% impairs the hot workability and weldability. Thus, the upper and lower limits for the B content are set at 0.008% and 0.001%, respectively.

The amounts of Ni and Co contained in the steel pipe or tube according to the present invention do not exceed 0.3% in weight, so that Ni and Co do not in any way impair the characteristics of the steel.

In a high-strength heat-resisting ferritic steel pipe or tube according to the present invention, the content of C is preferably from 0.03 to 0.12%, from the viewpoint of weldability and toughness.

The present invention will be described in more detain with reference to the following examples, which do not limit the scope of the invention in any way.

EXAMPLES

Table 2 shows the chemical composition of examples of the steel tube according to the present invention, and comparative examples thereto, the creep rupture time at 650° C. and 18 kg/mm$^2$, the rupture elongation, the weldability-indicated with the pre-heating temperature in a constraint Y-groove cracking test (JIS Z3158), the impact value after aging at 60020 C. for 1000 hours, and the tensile properties at room temperature.

In Table 2, Examples 10 to 17, and 31 to 33 are those of the steel tubes of the present invention, Examples 1 to 9, and 18 to 30 are Comparative Examples, in which Comparative Example 2 is a 2¼ Cr-1Mo steel tube, a low-alloy heat-resisting steel tube in general use, and Comparative Example 1 is an alloy steel tube used for a boiler heat exchanger, which has a further improved high-temperature corrosion resistance. The tubes of Comparative Examples 1 and 2 have a low creep rupture strength. Comparative Example 3 is a steel tube used for the superheater and reheater of a coal single-fuel combustion boiler, and has an extremely high C content compared with the Examples of the steel tubes of the present invention and, therefore, is difficult to weld and form. Comparative Examples 4 to 7 and 24 have W contents below the lower limit, and thus are lacking in creep rupture strength. Comparative Examples 8 and 9 have Mo contents below the lower limit, and thus are lacking creep rupture strength. Comparative Examples 18 to 21, 25, 26, 29, and 30 have Mo contents above the upper limit, and the toughness thereof is very much reduced after heating. Comparative Example 22 and 23 contains an amount of W above the upper limit and, therefore, has an extremely poor toughness after a long term exposure at a high temperature and an inferior weldability. Comparative Examples 27 and 28 have carbon contents outside the lower and upper limits, and thus have a lower creep rupture strength and a poor weldability, respectively.

On the contrary, the steel tubes according to the present invention are considerably superior to the steel tubes of Comparative Examples 1 and 3, existing heat-resisting ferritic steel tubes, and can be used at considerably high temperatures under the same level of loading stress.

The toughness of the steel tubes according to the present invention is on the same or at a higher level in comparison with that of an existing steel X20CrMoV121 (Comparative Example 3) and, therefore, no problems arise in practice.

Additionally, Examples 16 and 17 containing 0.27% Ni and 0.26% Ni+0.17% Co as impurities, respectively, have characteristics comparable with the other Examples of the steel tubes according to the present invention.

In Examples 31 to 33, which are covered by claim 3 of the present invention, the addition of B brings a further enhancement in the creep rupture strength.

TABLE 2

Chemical Compositions and Characteristics of Examples

| Example No. | Chemical composition (%) C | Mn | Cr | W | V | Nb | N | B | Mo | Si | Ni | Co | Tensile properties (Room temperature) Tensile strength (kg/mm²) | Elongation (%) | $_{\gamma}E_{20}$ after heating at 600° C. for $10^3$ h (kg-m/cm²) | Creep rupture properties (650° C., 18 kg/mm²) Rupture time (h) | Elongation (%) | Pre-heating temperature for arresting cracks in Y-groove cracking test (°C.) |
|---|---|---|---|---|---|---|---|---|---|---|---|---|---|---|---|---|---|---|
| *1 | 0.07 | 0.60 | 9.08 | — | — | — | — | — | 1.03 | 0.32 | — | — | 58.2 | 31.3 | — | 10 or less | — | 100 |
| *2 | 0.10 | 0.48 | 2.14 | — | — | — | — | — | 0.96 | 0.32 | — | — | 54.5 | 28.2 | — | 10 or less | — | 75 |
| *3 | 0.18 | 0.59 | 11.54 | 0.61 | 0.27 | — | — | — | 1.00 | 0.22 | 0.50 | — | 80.5 | 20.0 | 8.3 | 10 or less | — | 175 |
| *4 | 0.06 | 0.62 | 9.14 | 1.70 | 0.18 | 0.05 | 0.03 | — | 0.09 | 0.09 | — | — | 69.0 | 28.0 | 9.7 | 726 | 23.3 | 100 |
| *5 | 0.08 | 0.60 | 9.20 | 1.41 | 0.12 | 0.02 | 0.03 | — | 0.35 | 0.15 | — | — | 62.0 | 27.8 | 11.0 | 315 | 24.2 | 75 |
| *6 | 0.07 | 0.60 | 9.30 | 1.40 | 0.12 | 0.02 | 0.03 | — | 0.85 | 0.15 | — | — | 65.0 | 25.8 | 9.2 | 430 | 23.6 | 75 |
| *7 | 0.07 | 0.62 | 9.42 | 1.56 | 0.15 | 0.05 | 0.05 | — | 0.35 | 0.15 | — | — | 67.2 | 25.7 | 7.9 | 895 | 23.6 | 100 |
| *8 | 0.06 | 0.62 | 9.24 | 1.84 | 0.17 | 0.05 | 0.03 | — | <0.01 | 0.15 | — | — | 69.6 | 27.8 | 9.3 | 1035 | 23.0 | 100 |
| *9 | 0.06 | 0.63 | 9.30 | 2.24 | 0.17 | 0.05 | 0.03 | — | <0.01 | 0.08 | — | — | 72.0 | 26.3 | 7.6 | 1528 | 21.7 | 100 |
| 10 | 0.09 | 0.60 | 8.55 | 1.80 | 0.17 | 0.05 | 0.05 | — | 0.09 | 0.09 | — | — | 75.8 | 26.8 | 7.4 | 1768 | 22.8 | 100 |
| 11 | 0.06 | 0.62 | 9.08 | 2.26 | 0.14 | 0.05 | 0.03 | — | 0.09 | 0.10 | — | — | 73.2 | 25.9 | 6.2 | 1998 | 21.3 | 100 |
| 12 | 0.05 | 0.60 | 8.92 | 2.89 | 0.14 | 0.03 | 0.02 | — | 0.02 | 0.10 | — | — | 74.1 | 25.5 | 6.1 | 2011 | 21.1 | 125 |
| 13 | 0.07 | 0.64 | 9.09 | 1.87 | 0.20 | 0.05 | 0.03 | — | 0.32 | 0.15 | — | — | 73.2 | 26.1 | 7.5 | 2280 | 21.0 | 100 |
| 14 | 0.07 | 0.64 | 9.05 | 2.29 | 0.25 | 0.08 | 0.03 | — | 0.31 | 0.14 | — | — | 74.2 | 25.7 | 7.1 | 2415 | 21.0 | 100 |
| 15 | 0.07 | 0.61 | 9.21 | 2.85 | 0.12 | 0.05 | 0.03 | — | 0.32 | 0.15 | — | — | 75.0 | 25.2 | 6.8 | 2680 | 21.0 | 125 |
| 16 | 0.07 | 0.62 | 9.22 | 2.84 | 0.12 | 0.05 | 0.03 | — | 0.32 | 0.15 | 0.27 | — | 75.2 | 25.0 | 7.2 | 2695 | 21.3 | 125 |
| 17 | 0.07 | 0.62 | 9.22 | 2.80 | 0.10 | 0.04 | 0.03 | — | 0.30 | 0.16 | 0.26 | 0.17 | 74.6 | 25.8 | 6.9 | 2570 | 21.0 | 125 |
| *18 | 0.06 | 0.54 | 9.20 | 1.60 | 0.10 | 0.05 | 0.03 | — | 0.82 | 0.20 | — | — | 69.0 | 27.8 | 5.0 | 1210 | 24.1 | 150 |
| *19 | 0.06 | 0.60 | 9.00 | 1.75 | 0.10 | 0.04 | 0.03 | — | 0.85 | 0.21 | — | — | 74.0 | 26.1 | 5.0 | 2500 | 21.2 | 150 |
| *20 | 0.06 | 0.60 | 8.60 | 2.22 | 0.10 | 0.03 | 0.03 | — | 0.83 | 0.20 | — | — | 75.2 | 25.1 | 4.5 | 2600 | 22.5 | 150 |
| *21 | 0.06 | 0.61 | 8.99 | 2.72 | 0.10 | 0.03 | 0.03 | — | 0.77 | 0.21 | — | — | 75.8 | 25.0 | 3.5 | 2650 | 21.0 | 175 |
| *22 | 0.05 | 0.66 | 8.88 | 3.18 | 0.16 | 0.05 | 0.02 | — | 0.06 | 0.10 | — | — | 76.5 | 24.0 | 1.0 | 2340 | 20.8 | 150 |
| *23 | 0.06 | 0.54 | 8.55 | 3.15 | 0.12 | 0.03 | 0.03 | — | 0.82 | 0.20 | — | — | 75.8 | 25.3 | 1.0 or less | 2750 | 20.5 | 200 |
| *24 | 0.05 | 0.54 | 9.30 | 1.59 | 0.07 | 0.03 | 0.03 | — | 0.61 | 0.15 | — | — | 68.0 | 28.1 | 6.9 | 1040 | 24.6 | 125 |
| *25 | 0.07 | 0.60 | 9.01 | 2.32 | 0.20 | 0.05 | 0.03 | — | 0.62 | 0.16 | — | — | 74.8 | 27.2 | 5.6 | 2640 | 25.1 | 125 |
| *26 | 0.07 | 0.60 | 9.05 | 2.60 | 0.20 | 0.05 | 0.03 | — | 0.58 | 0.16 | — | — | 75.1 | 25.0 | 4.9 | 2685 | 20.4 | 150 |
| *27 | 0.02 | 0.61 | 9.00 | 1.80 | 0.20 | 0.05 | 0.03 | — | 0.32 | 0.15 | — | — | 70.4 | 28.1 | 6.5 | 495 | 26.6 | 75 |
| *28 | 0.17 | 0.60 | 9.02 | 1.87 | 0.20 | 0.05 | 0.03 | — | 0.33 | 0.14 | — | — | 76.2 | 25.0 | 7.2 | 2525 | 22.0 | 250 |
| *29 | 0.06 | 0.59 | 9.10 | 1.72 | 0.11 | 0.03 | 0.03 | — | 1.15 | 0.20 | — | — | 74.5 | 25.6 | 2.0 | 2740 | 21.6 | 175 |
| *30 | 0.06 | 0.59 | 9.13 | 2.68 | 0.12 | 0.03 | 0.03 | — | 1.18 | 0.20 | — | — | 76.1 | 25.0 | 1.0 or less | 2850 | 20.2 | 225 |
| 31 | 0.06 | 0.62 | 8.98 | 1.85 | 0.17 | 0.05 | 0.03 | 0.007 | 0.09 | 0.15 | — | — | 72.8 | 25.8 | 9.6 | 1960 | 21.5 | 100 |
| 32 | 0.07 | 0.63 | 9.07 | 1.85 | 0.20 | 0.05 | 0.03 | 0.003 | 0.33 | 0.15 | — | — | 73.4 | 26.8 | 7.8 | 2350 | 23.2 | 100 |
| 33 | 0.07 | 0.62 | 9.10 | 2.20 | 0.24 | 0.07 | 0.03 | 0.002 | 0.32 | 0.15 | — | — | 74.6 | 27.1 | 7.6 | 2495 | 24.8 | 100 |

*Comparative example.

We claim:

1. A high-strength heat-resisting ferritic steel in the form of a pipe or a tube having an improved creep rupture strength, said steel consisting, in weight percentage, of:

| | |
|---|---|
| C: | 0.03–0.15%, |
| Mn: | 0.1–1.5%, |
| Cr: | 8.0–13.0%, |
| W: | 1.8–3.0%, |
| V: | 0.05–0.30%, |
| Nb: | 0.02–0.12%, |
| N: | 0.02–0.05%, |
| Mo: | 0.02–0.4%, |
| Si: | 0.25% or less, |

with the remainder consisting of Fe and unavoidable impurities.

2. A high-strength, heat-resisting ferritic steel according to claim 1, wherein said C content is from 0.03 to 0.12% in weight.

3. A high-strength heat-resisting ferritic steel in the form of a pipe or a tube having an improved creep rupture strength, said steel consisting, in weight percentage, of:

| | |
|---|---|
| C: | 0.03–0.15%, |
| Mn: | 0.1–1.5%, |
| Cr: | 8.0–13.0%, |
| W: | 1.8–3.0%, |
| V: | 0.05–0.30%, |
| Nb: | 0.02–0.12%, |
| N: | 0.02–0.05%, |
| Mo: | 0.02–0.4%, |
| Si: | 0.25% or less, |
| B: | 0.001–0.008% |

with the remainder consisting of Fe and unavoidable impurities.

4. A high-strength, heat-resisting ferritic steel according to claim 3, wherein said C content is from 0.03 to 0.12% in weight.

5. A high-strength heat-resisting ferritic steel in the form of a pipe or a tube having an improved creep rupture strength, said steel consisting, in weight percentage, of:

| | |
|---|---|
| C: | 0.03–0.15%, |
| Mn: | 0.1–1.5%, |
| Cr: | 8.0–13.0%, |
| W: | 1.8–3.0%, |
| V: | 0.05–0.30%, |
| Nb: | 0.02–0.12%, |
| N: | 0.02–0.05%, |
| Mo: | 0.1–0.4%, |
| Si: | 0.25% or less, |

with the remainder consisting of Fe and unavoidable impurities.

6. A high-strength, heat-resisting ferritic steel according to claim 5, wherein said C content is from 0.03 to 0.12% in weight.

7. A high-strength heat-resisting ferritic steel in the form of a pipe or a tube having an improved creep rupture strength, said steel consisting, in weight percentage, of:

| | |
|---|---|
| C: | 0.03–0.15%, |
| Mn: | 0.1–1.5%, |
| Cr: | 8.0–13.0%, |
| W: | 1.8–3.0%, |
| V: | 0.05–0.30%, |
| Nb: | 0.02–0.12%, |
| N: | 0.02–0.05%, |
| Mo: | 0.1–0.4%, |
| Si: | 0.25% or less, |
| B: | 0.001–0.008% |

with the remainder consisting of Fe and unavoidable impurities.

8. A high-strength, heat-resisting ferritic steel according to claim 7, wherein said C content is from 0.03 to 0.12% in weight.

9. A high-strength heat-resisting ferritic steel in the form of a pipe or a tube having an improved creep rupture strength, said steel consisting, in weight percentage, of:

| | |
|---|---|
| C: | 0.03–0.15%, |
| Mn: | 0.1–1.5%, |
| Cr: | 8.0–13.0%, |
| W: | 1.8–3.0%, |
| V: | 0.05–0.30%, |
| Nb: | 0.02–0.12%, |
| N: | 0.02–0.05%, |
| Mo: | 0.02–0.1%, |
| Si: | 0.25% or less, |

with the remainder consisting of Fe and unavoidable impurities.

10. A high-strength, heat-resisting ferritic steel according to claim 9, wherein said C content is from 0.03 to 0.12% in weight.

11. A high-strength, heat-resisting ferritic steel in the form of a pipe or a tube having an improved creep rupture strength, said steel consisting, in weight percentage, of:

| | |
|---|---|
| C: | 0.03–0.15%, |
| Mn: | 0.1–1.5%, |
| Cr: | 8.0–13.0%, |
| W: | 1.8–3.0%, |
| V: | 0.05–0.30%, |
| Nb: | 0.02–0.12%, |
| N: | 0.02–0.05%, |
| Mo: | 0.02–0.1%, |
| Si: | 0.25% or less, |
| B: | 0.001–0.008% |

with the remainder consisting of Fe and unavoidable impurities.

12. A high-strength, heat-resisting ferritic steel according to claim 11, wherein said C content is from 0.03 to 0.12% in weight.

* * * * *

UNITED STATES PATENT AND TRADEMARK OFFICE

CERTIFICATE OF CORRECTION

PATENT NO. : 4,844,755

DATED : July 4, 1989

INVENTOR(S) : K. Hashimoto et al.

It is certified that error appears in the above-identified patent and that said Letters Patent is hereby corrected as shown below:

At Col. 5, line 47 delete "60020C" and insert -- 600°C --.

Signed and Sealed this

Eighth Day of May, 1990

*Attest:*

HARRY F. MANBECK, JR.

*Attesting Officer*

*Commissioner of Patents and Trademarks*